US009306267B2

(12) United States Patent
Liang et al.

(10) Patent No.: US 9,306,267 B2
(45) Date of Patent: Apr. 5, 2016

(54) ANTENNA ASSEMBLY INTEGRAL WITH METAL HOUSING AND ELECTRONIC DEVICE USING THE ANTENNA ASSEMBLY

(71) Applicant: Chiun Mai Communication Systems, Inc., New Taipei (TW)

(72) Inventors: Chia-Ming Liang, New Taipei (TW); Cho-Kang Hsu, New Taipei (TW)

(73) Assignee: Chiun Mai Communications Systems, Inc., New Taipei (TW)

( * ) Notice: Subject to any disclaimer, the term of this patent is extended or adjusted under 35 U.S.C. 154(b) by 380 days.

(21) Appl. No.: 14/014,641

(22) Filed: Aug. 30, 2013

(65) Prior Publication Data

US 2014/0354487 A1 Dec. 4, 2014

(30) Foreign Application Priority Data

May 31, 2013 (TW) ..... 102119263 A

(51) Int. Cl.
*H01Q 1/24* (2006.01)
*H01Q 9/42* (2006.01)
*H01Q 5/385* (2015.01)

(52) U.S. Cl.
CPC ..... *H01Q 1/243* (2013.01); *H01Q 5/385* (2015.01); *H01Q 9/42* (2013.01)

(58) Field of Classification Search
CPC ..... H01Q 1/243; H01Q 5/385; H01Q 9/42
USPC ..... 343/700 MS, 702, 829, 846
See application file for complete search history.

(56) References Cited

U.S. PATENT DOCUMENTS

| | | | | | |
|---|---|---|---|---|---|
| 5,365,246 | A * | 11/1994 | Rasinger | H01Q 1/243 | 343/702 |
| 5,711,014 | A * | 1/1998 | Crowley | H01Q 1/241 | 343/841 |
| 6,239,753 | B1 * | 5/2001 | Kado | G08C 17/04 | 343/702 |
| 6,642,892 | B2 * | 11/2003 | Masaki | H01Q 1/2266 | 343/700 MS |
| 7,161,548 | B2 * | 1/2007 | Tsukamoto | H01Q 13/10 | 343/702 |
| 7,315,284 | B2 * | 1/2008 | Hsu | H01Q 1/243 | 343/700 MS |
| 2007/0252764 | A1 * | 11/2007 | Keski-Opas | H01Q 1/243 | 343/702 |

* cited by examiner

*Primary Examiner* — Tho G Phan

(74) *Attorney, Agent, or Firm* — Novak Druce Connolly Bove + Quigg LLP

(57) ABSTRACT

The metal housing of a miniaturized electronic device is shaped to function as a multiband antenna assembly. The antenna assembly includes a feeding terminal, a radiator connecting to the feeding terminal, and a metal element. The metal element is part of a housing of the electronic device. The metal element includes two antenna units, both of which are adjacent to and spaced from the radiator. An electronic device using the antenna assembly is also described.

16 Claims, 2 Drawing Sheets

ANTENNA ASSEMBLY INTEGRAL WITH METAL HOUSING AND ELECTRONIC DEVICE USING THE ANTENNA ASSEMBLY

CROSS-REFERENCE TO RELATED APPLICATIONS

This application is related to co-pending U.S. Patent Application Ser. No. 14/014,633 entitled "ANTENNA ASSEMBLY AND ELECTRONIC DEVICE USING THE ANTENNA ASSEMBLY". Such application has the same assignee as the present application. The above-identified applications are incorporated herein by reference.

BACKGROUND

1. Technical Field

The present disclosure relates to antenna assemblies, especially to an antenna assembly integral with metal housing and an electronic device using the antenna assembly.

2. Description of Related Art

Miniaturization of electronic devices applies as well to antennas as for the electronic devices. At the same time, electronic devices having metal housings are popular since the metal housings have high strength, high heat dissipation, tactile satisfaction, and attractive appearance. However, when the electronic devices having metal housings are miniaturized, the keep-out zones of the antennas may be reduced. As a result, the sending/receiving efficiency for signals of the antennas is adversely affected.

Therefore, there is room for improvement within the art.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
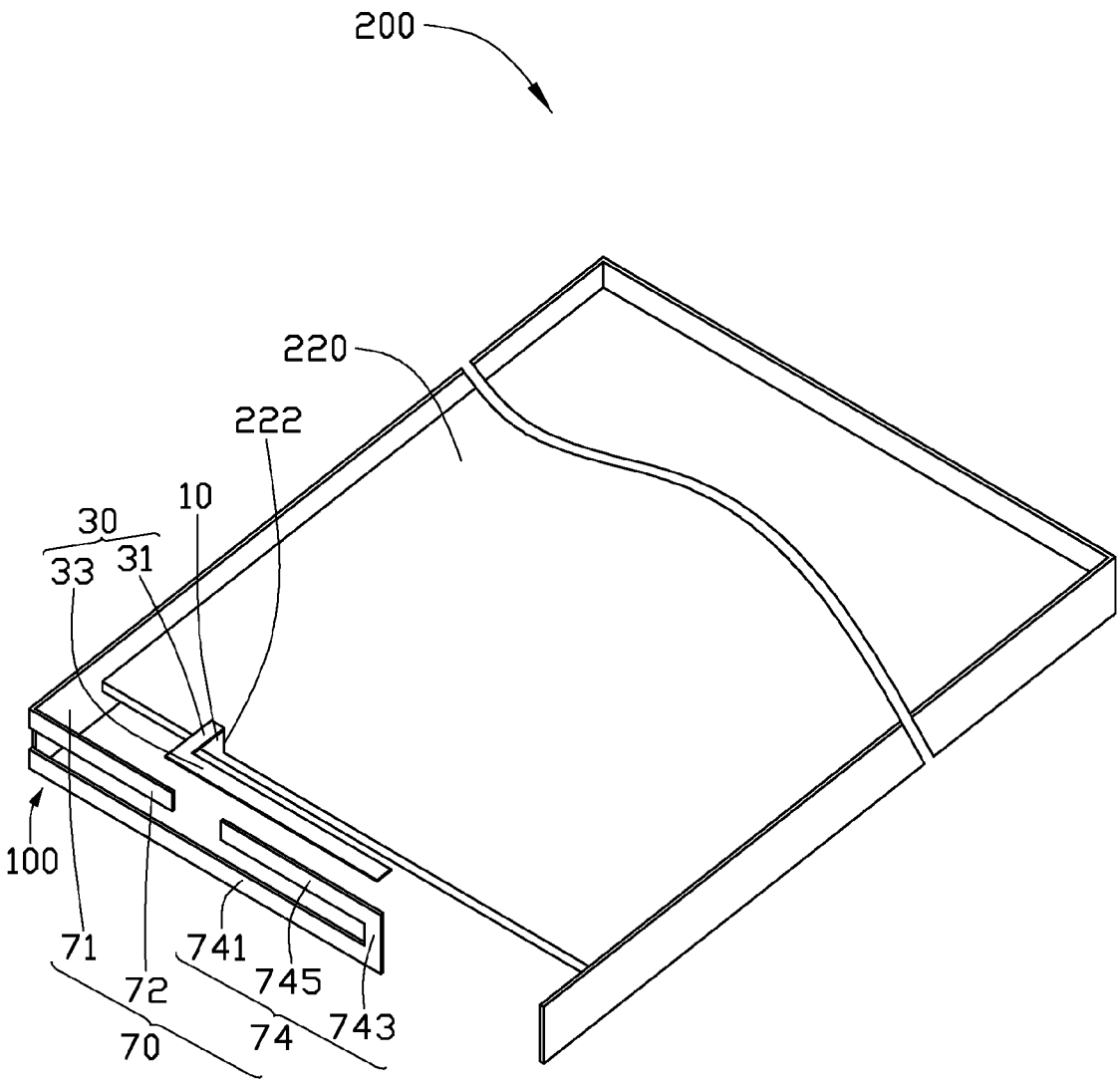
FIG. 1 is an isometric view of partial of an electronic device having an antenna assembly in accordance with an exemplary embodiment.

FIG. 1 shows an antenna assembly 100 which is used in an electronic device 200 having a metal housing. The electronic device 200 may be a mobile phone, a tablet computer, or a radio communication device, for example.

The electronic device 200 includes a circuit board 220. The circuit board 220 defines a feeding point 222, through which the circuit board 220 feeds electrical signals to the antenna assembly 100. The circuit board 220 also defines a grounding point (not shown).

The antenna assembly 100 includes a feeding terminal 10, a radiator 30, and a metal element 70. The feeding terminal 10 electrically connects to the feeding point 222. The radiator 30 connects to the feeding terminal 10. The metal element 70 is spaced from the radiator 30.

In the exemplary embodiment, the radiator 30 includes a first radiator 31 and a second radiator 33. The first radiator 31 is substantially perpendicularly connected to the feeding terminal 10. The second radiator 33 is substantially perpendicularly connected to the first radiator 33, and on a same plane as the first radiator 31. The length of the second radiator 33 is greater than the length of the first radiator 31.

The metal element 70 is metal and part of the metal housing of the electronic device 200. The metal element 70 includes a frame 71, a first antenna unit 72 and a second antenna unit 74, both of which extend from the frame 71. The frame 71 is connected to the grounding point of the circuit board 220 by screws or metallic flexible sheet (not shown).

The first antenna unit 72 is substantially perpendicularly connected to the frame 71. The first antenna unit 72 is on a first plane, the frame 71 is on a second plane, and the radiator 30 is on a third plane. The first plane, the second plane, and the third plane are vertical to each other. In the exemplary embodiment, the first antenna unit 72 is a sheet extending towards the radiator 30, and spaced from the second radiator 33. The second antenna unit 74 is also on the first plane. The second antenna unit 74 includes a first extending sheet 741, a second extending sheet 743, and a third extending sheet 745. The first extending sheet 741 extends towards a direction as the same as the first antenna unit 72. The first extending sheet 741 is parallel to and spaced from the first antenna unit 72, and has a length greater than the length of the first antenna unit 72. The second extending sheet 743 extends perpendicularly towards the radiator 30, and substantially perpendicularly connects to the first extending sheet 741 and the third extending sheet 745. The third extending sheet 745 extends towards the feeding terminal 10, and is spaced from the second radiator 33 and the first antenna unit 72. In the exemplary embodiment, the vertical distance between the third extending sheet 745 and the first extending sheet 741 is equal to the vertical distance between the first antenna unit 72 and the first extending sheet 741. The first antenna unit 72 and the first extending sheet 741 cooperatively define a first slot. The third extending sheet 745 and the first extending sheet 741 cooperatively define a second slot.

Figure 2:
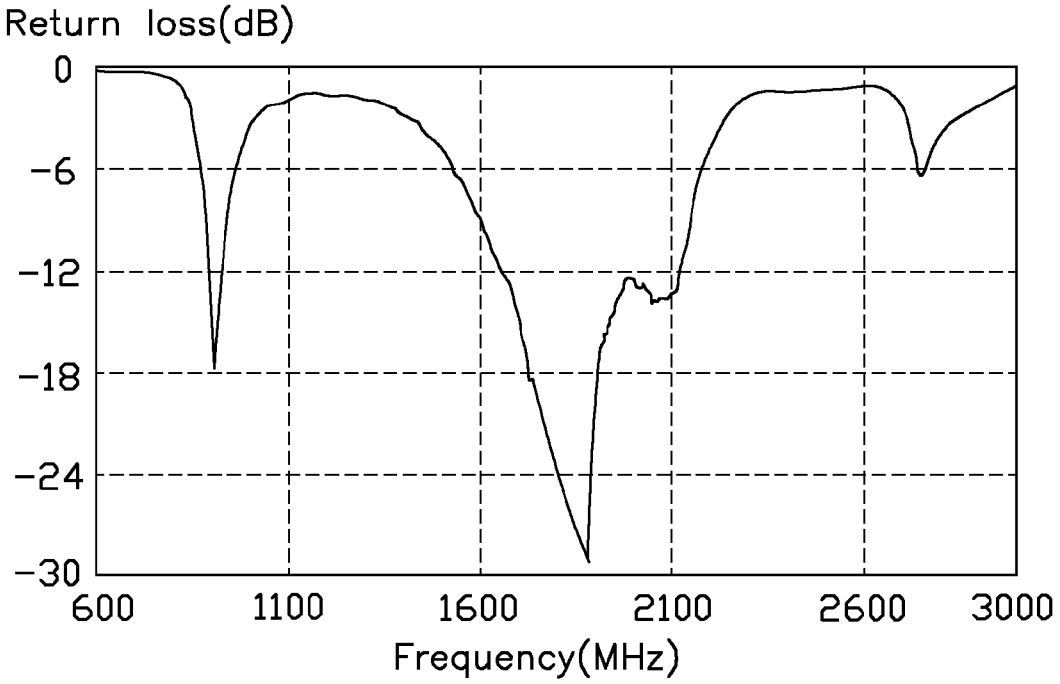
FIG. 2 is a return loss diagram for the antenna assembly of FIG. 1.

When the feeding terminal 10 passes electrical signals from the electronic device 200, the electricity flows through the first radiator 31 and the second radiator 33 to excite a first mode to receive or send a first signal, such as a WCDMA band2 signal. Since the first antenna unit 72 and the second antenna unit 74 both are parallel and adjacent to the second radiator 33, the electricity of the second radiator 33 can flow to the first antenna unit 72 and the second antenna unit 74. The electricity flowing to the first antenna unit 72 flows through the frame 71 and then to ground, allowing a second mode to be excited, to receive or send a second signal, such as a WCDMA band1 signal. The electricity flowing to the second antenna unit 74 flows through the third extending sheet 745, the second extending sheet 743, and the first extending sheet 741, in that order, to the frame 71 and then to ground, allowing a third mode to be excited, to receive or send a third signal, such as GSM850 signal and GSM900 signal. FIG. 2 shows that the antenna assembly 100 has a low return loss at a first bandwidth between about 800 MHz to about 900 MHz, at a second bandwidth between about 1800 MHz to about 1900 MHz, and at a third bandwidth between about 1900 MHz to about 2100 MHz.

The exemplary antenna assembly 100 utilizes the metal element 70 of the electronic device 200 to form both a first antenna unit 72 and a second antenna unit 74, which reduces the keep-out zone of the antenna assembly 100 without adversely affecting the efficiency of the antenna assembly 100. As a result, the size of the antenna assembly 100 and the electronic device 200 are reduced.

It is believed that the exemplary embodiment and its advantages will be understood from the foregoing description, and it will be apparent that various changes may be made thereto without departing from the spirit and scope of the disclosure or sacrificing all of its advantages, the examples hereinbefore described merely being preferred or exemplary embodiment of the disclosure.

What is claimed is:

1. An antenna assembly integral with metal housing for an electronic device, the antenna assembly comprising:

a feeding terminal;

a radiator connecting to the feeding terminal; and a metal element comprising a first antenna unit and a second antenna unit, the first antenna unit and the second antenna unit being adjacent to and spaced from the radiator, the metal element being metal and part of a housing of the electronic device.

2. The antenna assembly as claimed in claim 1, wherein the radiator comprises a first radiator and a second radiator, the first radiator is perpendicularly connected to the feeding terminal, the second radiator is perpendicularly connected to the first radiator and on a same plane as the first radiator.

3. The antenna assembly as claimed in claim 2, wherein the metal element comprises a frame, the first antenna unit is extended from an end of the frame, and towards the radiator.

4. The antenna assembly as claimed in claim 3, wherein the second antenna unit comprises a first extending sheet, the first extending sheet is extended from the end of the frame, parallel to and spaced from the first antenna unit.

5. The antenna assembly as claimed in claim 4, wherein the second antenna unit comprises a second extending sheet perpendicularly connected to the first extending sheet, the second extending sheet extends perpendicularly towards the radiator.

6. The antenna assembly as claimed in claim 5, wherein the second antenna unit comprises a third extending sheet perpendicularly connected to the second extending sheet, the third extending sheet extends towards the feeding terminal, and is parallel and adjacent to the second radiator.

7. The antenna assembly as claimed in claim 6, wherein the first extending sheet has a length greater than the length of the first antenna unit, the third extending sheet faces and spaces from the first antenna unit, the vertical distance between the third extending sheet and the first extending sheet is equal to the vertical distance between the first antenna unit and the first extending sheet.

8. The antenna assembly as claimed in claim 3, wherein the first antenna unit and the second antenna unit are on a first plane, the frame is on a second plane, the radiator is on a third plane, the first plane, the second plane, and the third plane are vertical to each other.

9. An electronic device, comprising:

a circuit board defining a feeding point and a grounding point;

a metal element; and an antenna assembly;

wherein the metal element comprises a frame connected to the grounding point, a first antenna unit extended from an end of the frame, and a second antenna unit also extended from the end of the frame, the antenna assembly comprises a feeding terminal electrically connected to the feeding point, and a radiator connecting to the feeding terminal, the first antenna unit and the second antenna unit are adjacent to and spaced from the radiator, the metal element is metal and part of a housing of the electronic device.

10. The electronic device as claimed in claim 9, wherein the radiator comprises a first radiator and a second radiator, the first radiator is perpendicularly connected to the feeding terminal, the second radiator is perpendicularly connected to the first radiator and on a same plane as the first radiator.

11. The electronic device as claimed in claim 10, wherein the metal element comprises a frame, the first antenna unit is extended from an end of the frame, and towards the radiator.

12. The electronic device as claimed in claim 11, wherein the second antenna unit comprises a first extending sheet, the first extending sheet is extended from the end of the frame, parallel to and spaced from the first antenna unit.

13. The electronic device as claimed in claim 12, wherein the second antenna unit comprises a second extending sheet perpendicularly connected to the first extending sheet, the second extending sheet extends perpendicularly towards the radiator.

14. The electronic device as claimed in claim 13, wherein the second antenna unit comprises a third extending sheet perpendicularly connected to the second extending sheet, the third extending sheet extends towards the feeding terminal, and is parallel and adjacent to the second radiator.

15. The electronic device as claimed in claim 14, wherein the first extending sheet has a length greater than the length of the first antenna unit, the third extending sheet faces and spaces from the first antenna unit, the vertical distance between the third extending sheet and the first extending sheet is equal to the vertical distance between the first antenna unit and the first extending sheet.

16. The electronic device as claimed in claim 11, wherein the first antenna unit and the second antenna unit are on a first plane, the frame is on a second plane, the radiator is on a third plane, the first plane, the second plane, and the third plane are vertical to each other.

* * * * *